US006311423B1

(12) United States Patent
Graham

(10) Patent No.: US 6,311,423 B1
(45) Date of Patent: Nov. 6, 2001

(54) STOCKBUTT SYSTEM

(76) Inventor: Kenneth L. Graham, 466 Graham Rd., Judsonia, AR (US) 72081

( * ) Notice: Subject to any disclaimer, the term of this patent is extended or adjusted under 35 U.S.C. 154(b) by 0 days.

(21) Appl. No.: 09/697,462

(22) Filed: Oct. 26, 2000

Related U.S. Application Data

(63) Continuation-in-part of application No. 09/195,976, filed on Nov. 19, 1998.

(51) Int. Cl.[7] ..... F41C 23/08
(52) U.S. Cl. ..... 42/74
(58) Field of Search ..... 42/71.01, 74; D22/111

(56) References Cited

U.S. PATENT DOCUMENTS

| | | | | |
|---|---|---|---|---|
| D. 376,188 | * | 12/1996 | Riecken | D22/111 |
| 544,269 | * | 8/1895 | Winters | 42/74 |
| 799,037 | * | 9/1905 | Duncan | 42/74 |
| 837,455 | * | 12/1906 | Duncan | 42/74 |
| 1,328,924 | * | 1/1920 | Kennedy | 42/74 |
| 2,924,904 | * | 2/1960 | Amsler | 42/74 |
| 4,120,108 | * | 10/1978 | Vickers et al. | 42/74 |
| 4,551,937 | * | 11/1985 | Seehase | 42/74 |
| 5,375,360 | * | 12/1994 | Vatterott | 42/74 |
| 5,461,813 | * | 10/1995 | Mazzola | 42/74 |

FOREIGN PATENT DOCUMENTS

2645952-B1 * 10/1990 (FR) .

* cited by examiner

*Primary Examiner*—Darren W. Ark

(57) ABSTRACT

A stockbutt system for rifles to abate shock during the firing of a rifle is disclosed, having a butt at the near end. The system includes a rifle and an insert with the butt having a near most first end in a generally planar configuration perpendicular to the axis of the barrel. The first end of the butt has a concave configuration when viewed from the side and a teardrop configuration when viewed from the end. The teardrop shape includes an upper semicircular curve at the top with a diameter essentially equal to the diameter of the widest portion of the butt. The teardrop shape further includes downwardly tapering side edges terminating in a U-shaped configuration at the bottom. The lower semicircular curve has a diameter less than the upper semicircular curve. The insert has an essentially flat far most face in its size and shape to correspond to the rearmost face of the butt. The insert is provided being fabricated of an elastomeric material to abate vibrations during the firing of a rifle. A coupling component couples the far most face of the insert and the rearmost face of the butt.

1 Claim, 2 Drawing Sheets

STOCKBUTT SYSTEM

RELATED APPLICATION

The present application is a continuation in part of copending U.S. patent application Ser. No. 09/195,976 filed Nov. 19, 1998.

BACKGROUND OF THE INVENTION

1. Field of the Invention

The present invention relates to a stockbutt system and more particularly pertains to abating shock during the firing of a rifle.

2. Description of the Prior Art

The use of firing arms of various designs and configurations is known in the prior art. More specifically, firing arms of various designs and configurations heretofore devised and utilized for the purpose of improving the use of firing arms through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,375,360 to Vatterott discloses a Cushioned Shoulder Pad for Rifle or Shotgun. U.S. Pat. No. 4,551,937 to Seehase discloses a Recoil Pad Utilizing Struts Disposed At a Compound Angle and Having Adjustable Energy-Absorbing Characteristics.

U.S. Pat. No. 5,461,813 to Mazzola discloses an Air Coil. U.S. Pat. No. Des. 376,188 to Rjecken discloses a Gun Stock Recoil Pad. International Application Number PCT/US87/02445 to Electronic Warfare Associates, Inc. discloses a Trigger Means for a Weapon Control System. Lastly, U.S. Pat. No. 1,328,924 to Kennedy discloses a Resilient Recoil Pad for Gun Stocks.

While these devices fulfill their respective, particular objectives and requirements, the aforementioned patents do not describe stockbutt system as disclosed herein.

In this respect, the stockbutt system according to the present invention substantially departs from the conventional concepts and designs of the prior art, and in doing so provides an apparatus primarily developed for the purpose of abating shock during the firing of a rifle.

Therefore, it can be appreciated that there exists a continuing need for a new and improved stockbutt system which can be used to abate shock during the firing of a rifle. In this regard, the present invention substantially fulfills this need.

SUMMARY OF THE INVENTION

In view of the foregoing disadvantages inherent in the known types of firing arms of various designs and configurations now present in the prior art, the present invention provides an improved stockbutt system. As such, the general purpose of the present invention, which will be described subsequently in greater detail, is to provide a new and improved stockbutt system which has all the advantages of the prior art and none of the disadvantages.

To attain this, the present invention essentially comprises a new and improved stockbutt system for rifles to abate shock during the firing of a rifle comprising, in combination, a rifle having a barrel at the far end and a butt at the near end with firing mechanisms and a trigger there between. The butt of the rifle has a near most first end in a generally planar configuration perpendicular to the axis of the barrel. An insert has a first end with a concave configuration when viewed from the side and a teardrop configuration when viewed from the end. The teardrop shape includes an upper semicircular curve at the top with a diameter essentially equal to the diameter of the widest portion of the butt and with downwardly tapering side edges terminating in a U-shaped configuration at the bottom. The lower semicircular curve has a diameter less than the upper semicircular curve. The insert has an essentially flat farmost face in its size and shape to correspond to the rearmost face of the butt. A coupling component is provided in the form of an adhesive coupling the far most face of the insert to the rearmost face of the stock. The insert is fabricated of an air imperforate elastomeric material with an associated valve to allow for the inflation of the insert with air of sufficient pressure to conform to the intended shape and to abate vibration during the firing of the rifle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form subject matter of the claims appended hereto.

In this respect, before explaining at least one embodiment of the invention in detail, it is to be understood the invention is not limited in its application to the details of construction and to the arrangements of the components forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stockbutt system which has all of the advantages of the prior art firing arms of various designs and configurations and none of the disadvantages.

It is another object of the present invention to provide a new and improved stockbutt system which may be easily and efficiently manufactured and marketed.

It is further object of the present invention to provide a new and improved stockbutt system which is of durable and reliable constructions.

An even further object of the present invention is to provide a new and improved stockbutt system which is susceptible of a low cost of manufacture with regard to both materials and labor, and which accordingly is then susceptible of low prices of sale to the consuming public, thereby making such Stockbutt system economically available to the buying public.

Even still another object of the present invention is to provide a stockbutt system for abating shock during the firing of a rifle.

Lastly, it is an object of the present invention to provide a new and improved stockbutt system for rifles comprising a rifle having a butt at the near end having a near-most first end in a generally planar configuration perpendicular to the axis of the barrel. Also included is an insert with a first end which has a concave configuration when viewed from the side and a teardrop configuration when viewed from the end. The teardrop shape includes an upper semicircular curve at the top with a diameter essentially equal to the diameter of the widest portion of the butt and with downwardly tapering side edges terminating in a U-shaped configuration at the bottom. The lower semicircular curve has a diameter less than the upper semicircular curve. The insert has an essentially flat farmost face in its size and shape to correspond to the rearmost face of the butt. An insert is provided being fabricated of an elastomeric material to abate vibrations during the firing of a rifle. A coupling component couples the farmost face of the insert and the rearmost face of the butt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
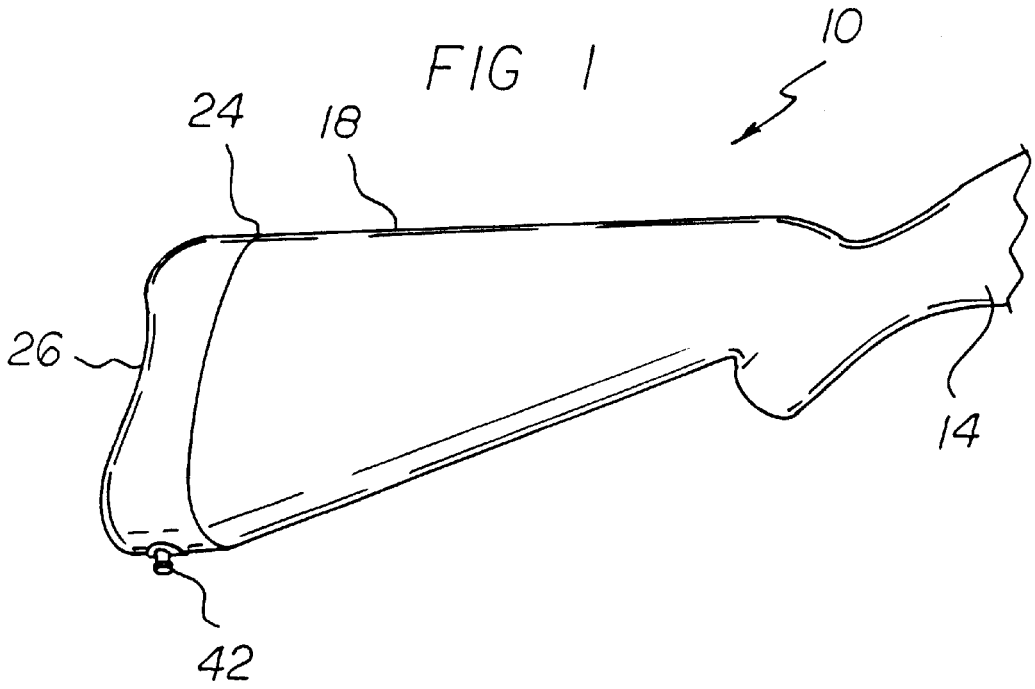
FIG. 1 is a perspective view of the preferred embodiment of the stockbutt system constructed in accordance with the principles of the present invention.
Figure 2:
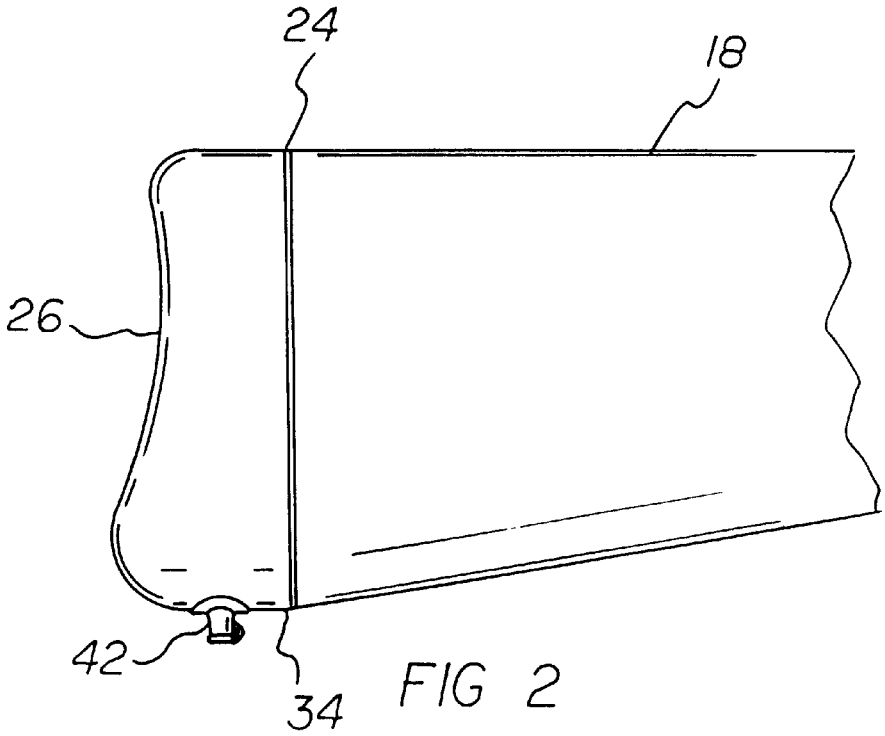
FIG. 2 is an enlarged side elevational view of the end of the rifle shown in FIG. 1.
Figure 3:
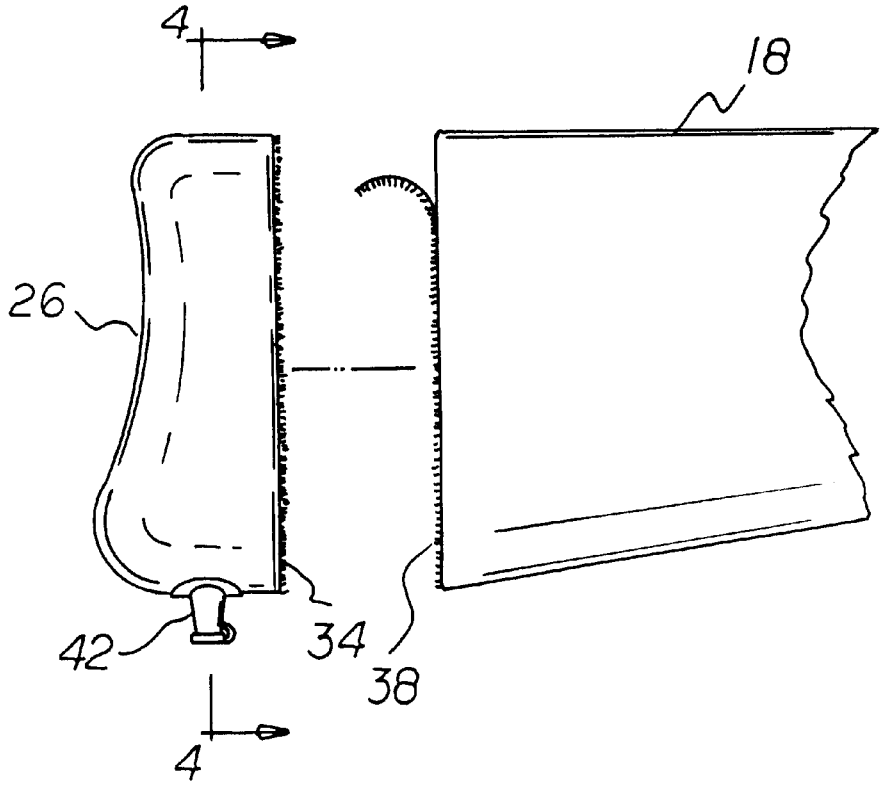
FIG. 3 is an exploded side elevational view similar to FIG. 2 but with parts broken-away to show certain internal constructions thereof.
Figure 4:
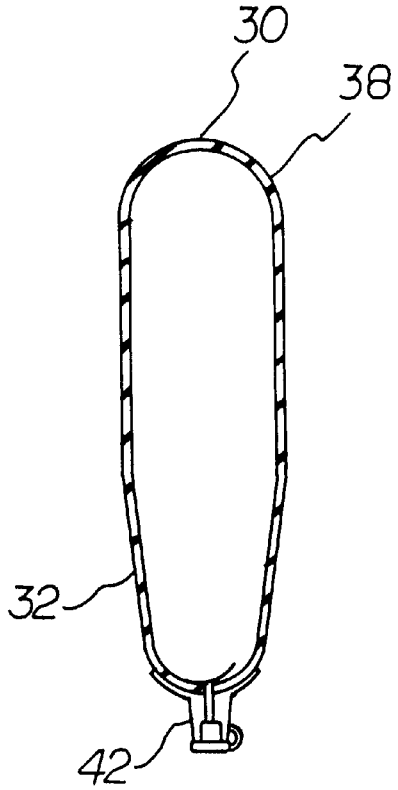
FIG. 4 is a cross-sectional view taken along line 4—4 of FIG. 3.

With reference now to the drawings, and in particular to FIG. 1 thereof, the preferred embodiment of the new and improved stockbutt system embodying the principles and concepts of the present invention and generally designated by the reference numeral 10 will be described.

The present invention, the stockbutt system 10, is comprised of a plurality of components. Such components in their broadest context include a rifle, an insert, a coupling component and an insert. Such components are individually configured and correlated with respect to each other so as to attain the desired objective.

The new and improved stockbutt system 10 for rifles to abate shock during the firing of a rifle comprises a rifle 14 having a barrel at the far end and a butt 18 at the near end The rifle further includes firing mechanisms and also a trigger there between.

The butt of the rifle has a near most first end 24 in a generally planar configuration perpendicular to the axis of barrel.

The next component is an insert with a first end having a concave configuration 26 when viewed from the side and a teardrop configuration 28 when viewed from the end. The teardrop shape includes an upper semi-circular curve 30 at the top with a diameter essentially equal to the diameter of the widest portion of the butt. The shape further includes downwardly tapering side edges 32 terminating in a U-shaped configuration at the bottom. The lower semicircular curve has a diameter less than the upper semicircular curve. The insert has an essentially flat far most face 34 with its size and shape to correspond to the rearmost face of the butt. The adjacent peripheral surfaces of the butt and insert form a smooth continuation of the butt with the insert.

Also provided is a coupling component 38 coupling the far most face of the insert to the rear most face of the stock. The coupling component is in the form of hook and loop fasteners on adjacent faces of the butt and insert with an adhesive coupling the fasteners to the far most face of the insert and the rearmost face of the butt.

The insert is fabricated of an air imperforate elastomeric material with an associated valve 42 extending downwardly to allow for the inflation of the insert with air of sufficient pressure to conform to the intended shape and to abate vibration during firing of the rifle.

The system of the present invention as described herein above is a device to be attached to the end of a gun stock that will help absorb shock from recoil and provide protection from accidental misfiring if the gun should be dropped or hit on the stock. The device will also help prevent loss of the gun if it should be dropped in the water during waterfowl hunting. The air bladder safety is a heavy-duty bladder shaped and sized to fit upon the end of a gun stock. The bladder forms an elongated oval shape, approximately five inches long, 1 ¾ inches wide, and one inch in depth. On the side to be attached to the gun stock is a section of hook-and-loop fastening system corresponding portion of hook-and-loop fastening system is supplied with a peel-n-stick backing to allow easy attachment to the gun stock.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A stockbutt system for rifles to abate shock during the firing of a rifle comprising, in combination:

a rifle having a far end and a near end with a barrel at the far end and a butt at the near end with firing mechanisms and a trigger there between, the butt of the rifle having a near most first end in a generally planar configuration perpendicular to the axis of the barrel;

a continuous, uninterrupted hollow insert with a first end having a concave configuration when viewed from a side and a teardrop shaped configuration when viewed from the first end, the teardrop shape including an upper semicircular curve at a top with a diameter essentially equal to the diameter of the widest portion of the butt and with downwardly tapering side edges terminating in a U-shaped configuration at a bottom, the teardrop shape also including a lower semicircular curve having a diameter less than the upper semicircular curve, the insert having an essentially flat far most face at a second end with a size and shape to correspond to a rearmost face of the butt; and a coupling component in the form of hook and loop fasteners on the rearmost and flat farmost faces of the butt and insert respectively with an adhesive coupling the fasteners to the far most face of the insert and the rearmost face of the butt, the insert being fabricated of an air imperforate elastomeric material with an associated valve to allow for the inflation of the insert with air of sufficient pressure to conform to the intended shape and to abate vibration during the firing of the rifle, the valve being located at a lower most extent of the insert.

* * * * *